US007231780B2

(12) United States Patent
Park

(10) Patent No.: US 7,231,780 B2
(45) Date of Patent: Jun. 19, 2007

(54) DAMPER DEVICE FOR REFRIGERATOR

(75) Inventor: Jung-Bum Park, Incheon (KR)

(73) Assignee: Moatech Co., Ltd., Namdong-gu Incheon (KR)

( * ) Notice: Subject to any disclaimer, the term of this patent is extended or adjusted under 35 U.S.C. 154(b) by 183 days.

(21) Appl. No.: 10/906,957

(22) Filed: Mar. 14, 2005

(65) Prior Publication Data

US 2006/0168989 A1 Aug. 3, 2006

(30) Foreign Application Priority Data

Feb. 1, 2005 (KR) ..... 10-2005-0008965

(51) Int. Cl.
*F25D 17/04* (2006.01)

(52) U.S. Cl. ..... 62/408

(58) Field of Classification Search ..... 62/187, 62/408, 180, 186; 236/49.3, 49.5; 454/256, 454/295; 251/307, 129.11
See application file for complete search history.

(56) References Cited

U.S. PATENT DOCUMENTS 3,170,680 A * 2/1965 Keefer ..... 432/39
4,245,481 A * 1/1981 McDermott ..... 62/187
5,117,900 A * 6/1992 Cox ..... 165/53
5,876,014 A * 3/1999 Noritake et al. ..... 251/129.12
6,244,564 B1 * 6/2001 Noritake ..... 251/129.11
6,338,467 B1 * 1/2002 Mabboux et al. ..... 251/305
6,364,211 B1 * 4/2002 Saleh ..... 236/49.3
2004/0084542 A1 * 5/2004 DeYoe et al. ..... 236/49.3

FOREIGN PATENT DOCUMENTS

JP 3-265444 A * 11/1991

* cited by examiner

*Primary Examiner*—Mohammad M. Ali
(74) *Attorney, Agent, or Firm*—John K. Park; Park Law Firm

(57) ABSTRACT

A damper device for a refrigerator has a step motor used as the power source for rotating a baffle to open/close the cold air passage of the refrigerator in a more secured manner. The damper device for a refrigerator includes a frame installed in the cold air passage of the refrigerator and provided with an opening at the center thereof, a baffle rotatably installed on the frame to open/close the opening, a gear-equipped step motor installed on a surface of the frame and having a reduction gear and a motor integrally formed therein to transmit a rotation force necessary for opening/closing operation of the baffle, and a stopper adapted to mechanically limit the baffle in such a manner that it can be positioned in the desired opening position.

5 Claims, 5 Drawing Sheets

DAMPER DEVICE FOR REFRIGERATOR

TECHNICAL FIELD

The present invention relates to a damper device for a refrigerator, and more particularly to a damper device for a refrigerator, which has a step motor used as the power source for rotating a baffle to open/close the cold air passage of the refrigerator in a more secured manner.

BACKGROUND ART

In general, a refrigerator is provided with a damper device in the cold air passage, such as a duct, to regulate the flow of cold air inside the refrigerator and maintain the temperature within the refrigerator at a preset temperature.

The present invention has been made to improve the prior art disclosed in Korean Registered Utility Model No. 20-0285567 in the name of the present applicant, entitled "REFRIGERATOR DAMPER USING GEAR-EQUIPPED STEP MOTOR", the disclosure of which will now be described with reference to FIG. 1.

As shown in FIG. 1, the refrigerator damper 100 using a gear-equipped step motor a frame 110 installed in the cold air passage and provided with an opening 114, a baffle 130 adapted to regulate the flow of cold air in the opening 114 of the frame 110, and a gear-equipped step motor 120 installed in a motor case formed on a side of the frame 110 to rotate the baffle 130 a predetermined angle based on the temperature condition of the refrigerator.

The baffle 130 is a square plate and is adapted to be rotated a predetermined angle by the gear-equipped step motor 120 to open/close the opening 114 of the frame 110. The baffle 130 has an output shaft cap 132 formed on a side thereof to be inserted into and coupled to the output shaft 122 of the gear-equipped step motor 120 and a rotation support shaft cap 134 formed on the other side thereof into which the rotation support shaft 112 formed on the frame 110 is inserted and coupled to support the rotation of the output shaft.

As currents are applied to the gear-equipped step motor 120, it generates a rotation force which is transmitted to the output shaft cap 132 inserted and coupled to the output shaft 122. The baffle 130 is then reciprocally rotated by the rotation force within a predetermined range of rotation angle to open/close the opening 114 and control the outflow of the cold air.

When the baffle 130 completely closes the opening 114, the flow of cold air is interrupted and, when the baffle 130 completely opens the opening 114, the flow of cold air is maximized. As such, the amount of cold air flowing into the refrigerating chamber or the freezing chamber is regulated.

When the baffle position (rotation angle) of the damper is controlled by the conventional gear-equipped step motor, however, the gear-equipped step motor may operate erroneously and the rotation angle of the baffle may exceed a desired range. Thus, the opening/closing operation of the baffle becomes unreliable frequently.

Particularly, the step motor has a preset rotation angle corresponding to each electrical input signal (pulse) and is suitable for position control. When a predetermined frequency or pulse is applied to the gear-equipped step motor for opening operation of the baffle, the absence of a means for limiting the maximum rotation angle of the baffle generates frequent errors in the baffle position.

Such errors in the baffle position due to the gear-equipped step motor make the opening/closing operation of the baffle inaccurate. When the baffle incompletely opens the opening, the circulation of cold air within the refrigerator is disturbed and, when the baffle incompletely closes the opening, the cold air leaks out and the efficiency of the refrigerator degrades.

When the baffle position of the damper is controlled by the gear-equipped step motor, it is difficult to install a means for limiting the maximum rotation angle of the baffle, e.g., a stopper, inside the gear-equipped step motor. Even when such a means is installed therein, it is not easy to adjust the initial position when the damper is assembled.

DISCLOSURE OF THE INVENTION

Therefore, the present invention has been made in view of the above-mentioned problems, and it is an object of the present invention to provide a damper device for a refrigerator, which has a gear-equipped step motor used as the driving source for opening/closing operation of a baffle and a mechanical means for limiting the desired maximum opening position of the baffle for more secured opening/closing operation thereof.

According to an aspect of the present invention, there is provided a damper device for a refrigerator, which includes a frame installed in the cold air passage of the refrigerator and provided with an opening at the center thereof, a baffle rotatably installed on the frame to open/close the opening, a gear-equipped step motor installed on a surface of the frame and having a reduction gear and a motor integrally formed therein to transmit a rotation force necessary for opening/closing operation of the baffle, and a stopper adapted to mechanically limit the baffle in such a manner that it can be positioned in the desired opening position.

The baffle has an output shaft cap formed on a surface thereof to be coupled to an output shaft of the gear-equipped step motor and a rotation support shaft cap formed on the other surface thereof to be coupled to a rotation support shaft formed on the frame.

The stopper is installed on each of the baffle and the frame.

Alternatively, the stopper is installed on the baffle or the frame.

The stopper has a baffle stopper protruding from the output shaft cap of the baffle.

The stopper has a step-shaped frame stopper formed on a portion of the frame abutting the baffle stopper when the baffle is in the desired maximum opening position.

The stopper has a number of baffle stoppers formed on the back surface of the baffle in the shape of protrusions.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Reference will now be made in detail to the preferred embodiments of the present invention.

Figure 1:
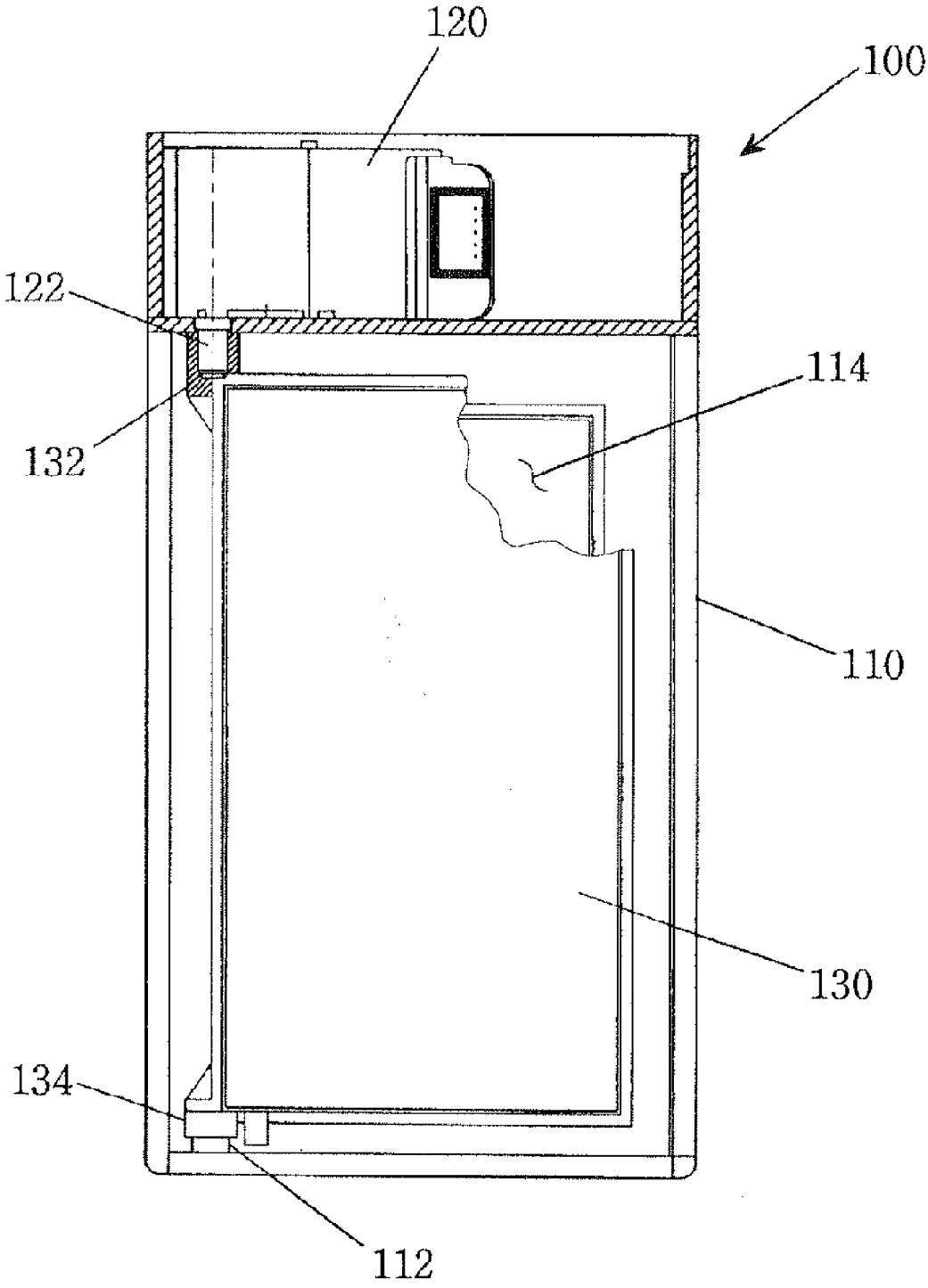
FIG. 1 Prior Art
FIG. 1 a partially-broken front view showing a conventional damper device for a refrigerator when its baffle has closed the opening.
Figure 2:
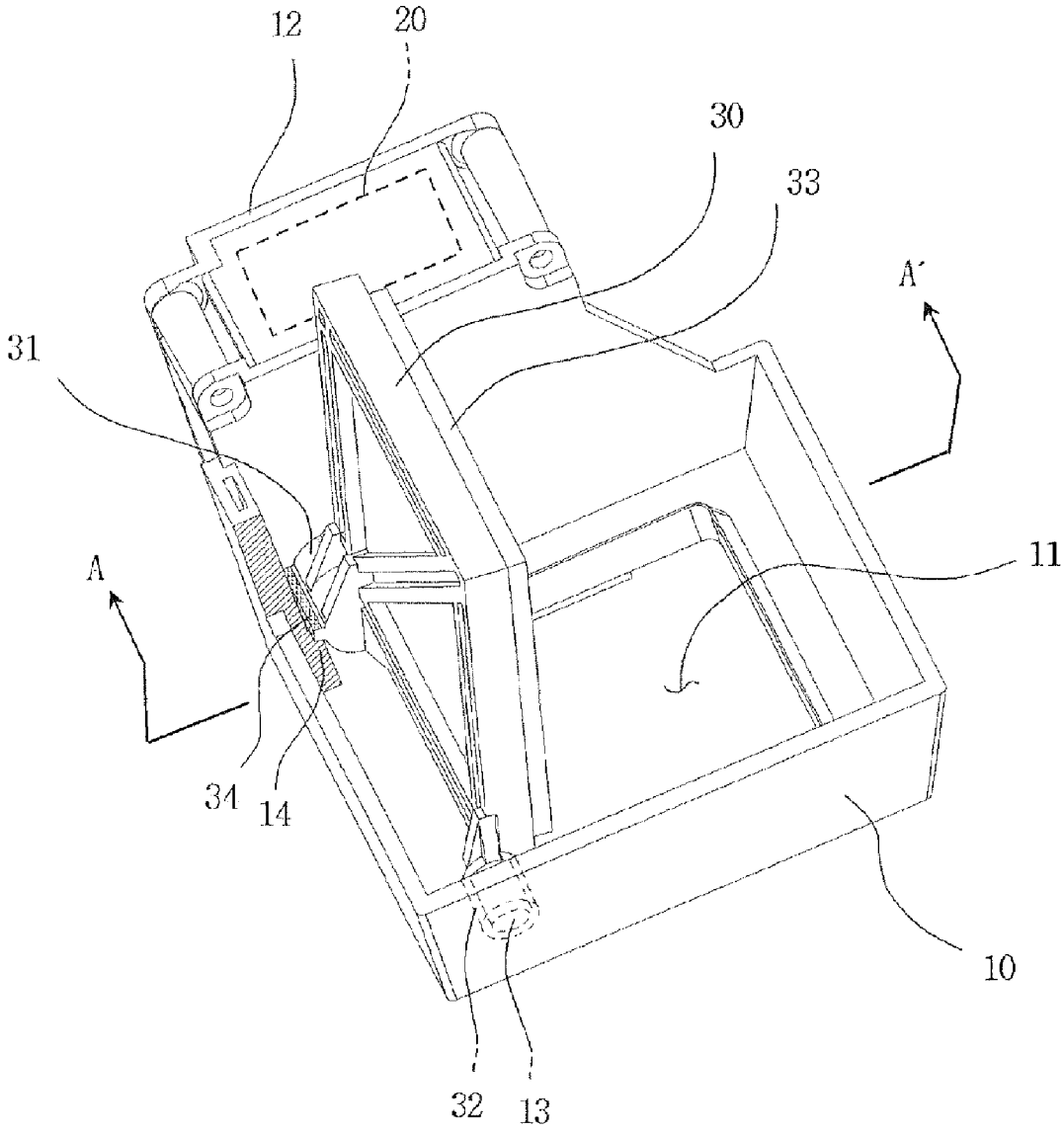
FIG. 2 is a perspective view showing a damper device for a refrigerator according to the present invention when its baffle has opened the opening.
Figure 3:
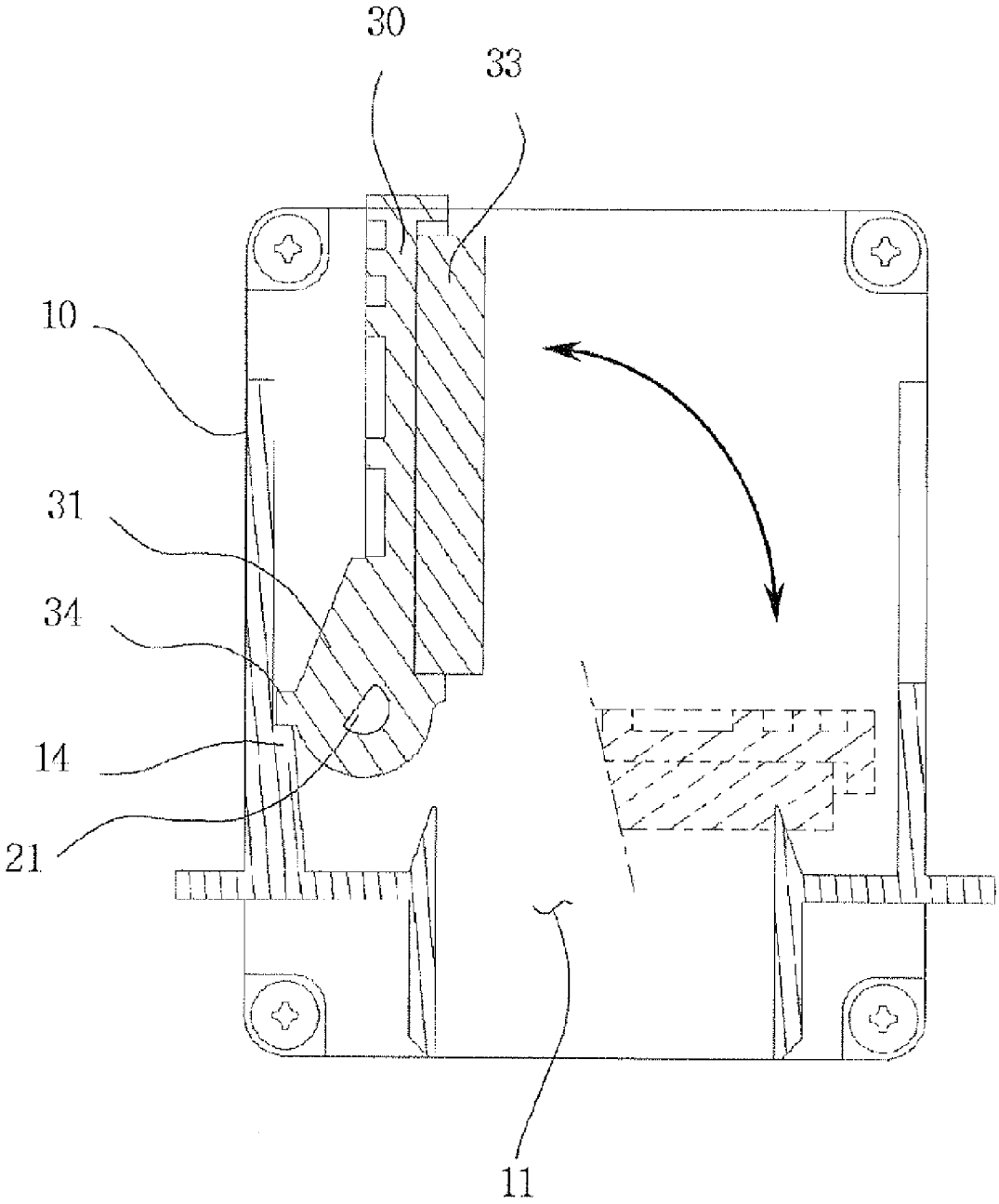
FIG. 3 is a sectional view taken along line A–A' of FIG. 2.

FIG. 2 is a perspective view showing a damper device for a refrigerator according to the present invention when its baffle has opened the opening and FIG. 3 is a sectional view taken along line A–A' of FIG. 2.

As shown in FIGS. 2 and 3, the damper device for a refrigerator according to the present invention includes a frame 10 installed in the cold air passage of the refrigerator and provided with an opening 11, a gear-equipped step motor 20 installed on a side of the frame 10 to generate a rotation force, a baffle 30 installed in the opening 11 of the frame 10 to receive the rotation force from the step motor 20 for opening/closing operation, and stoppers 14 and 34 adapted to limit the maximum degree of openness of the opening 11 by the baffle 30.

The construction of the damper device for a refrigerator will now be described in more detail.

The frame 10 has an opening 11 formed at the center thereof through which cold air flows and a motor case 12 formed on a side thereof to contain the gear-equipped step motor 20.

The gear-equipped step motor 20 has a motor and a reduction gear integrally formed therein and is adapted to reciprocally rotate at predetermined speed and rotation angle based on a pulse and/or frequency signal supplied from the exterior.

The gear-equipped step motor 20 is installed inside the motor case 12 and has an output shaft 21 protruding and extending through the bottom surface of the motor case 12.

The output shaft 21 is coupled to a output shaft cap 31 formed on a side of the baffle 30 to transmit the rotation force from the gear-equipped step motor 20 to the baffle 30.

The baffle 30 has a rotation support cap 32 formed on the other side thereof to be coupled to a rotation support shaft 13 formed on the frame 10, in order to smoothly transmit the rotation force from the gear-equipped step motor 20 to the baffle 30.

The baffle 30 is a square plate and has an output shaft cap 31 formed on a side thereof into which the output shaft 21 is inserted and a rotation support shaft cap 32 formed on the other side thereof into which the rotation support shaft 13 formed on the frame 10 is inserted. The baffle 30 also has a buffering member 33 formed on a surface thereof abutting the opening 11 for improved buffering and sealing effect when the baffle 30 closes the opening 11.

The buffering member 33 preferably has foamed polyurethane, rubber, or a soft tape member formed on a surface thereof abutting the opening 11 for improved buffering and sealing effect.

The opening 11 preferably has a protrusion formed on the periphery thereof for improved sealing effect when the baffle 30 closes the opening 11.

The baffle 30 is mounted on the frame 10 in such a manner that it can reciprocally rotate about the output shaft 21 and the rotation support shaft 13 and is adapted to open/close the opening 11 of the frame 10 as the reciprocating rotational motion is transmitted from the gear-equipped step motor 20.

The baffle 30 has a baffle stopper 34 protruding from the output shaft cap 31 to mechanically limit the maximum opening position of the baffle 30 during opening operation.

The baffle stopper 34 engages the frame stopper 14 protruding from the frame 10 when the baffle 30 is in the maximum opening position and prevents the baffle 30 from rotating any further.

Specifically, the baffle stopper 34 protruding from the output shaft cap 31 of the baffle 30 is adapted to abut the frame stopper 14 formed inside the frame 10 in a step configuration.

As such, the frame stopper 14 abuts the baffle stopper 34 on the output shaft cap 31 in the rotation direction of the baffle 30 when the baffle 30 is in the maximum opening position.

The baffle and frame stoppers 34 and 14 play the role of mechanically constraining the baffle 30 when it opens the opening 11 to the maximum degree at a specific angle and preventing it from rotating further.

The position of the baffle 30 in which its rotation is constrained by the baffle and frame stoppers 34 and 14 coincides with the desired position of the baffle 30 in which the rotation angle of the baffle 30 in its maximum opening condition is limited by the step motor according to a pulse and/or frequency.

Accordingly, the baffle 30 is prevented from opening the opening 11 further from the desired maximum opening position and from incompletely closing the opening 11 due to erroneous operation of the step motor.

Not only the stoppers 14 and 34 cause the baffle 30 to completely close the opening 11 during closing operation of the baffle 30, but also the detent torque of the gear-equipped step motor 20 causes the baffle 30 to close the opening 11 in a more secured manner. This completely avoids leakage of cold air.

A damper device for a refrigerator having modified position and shape of the stoppers according to another embodiment of the present invention will now be described.

Figure 4:
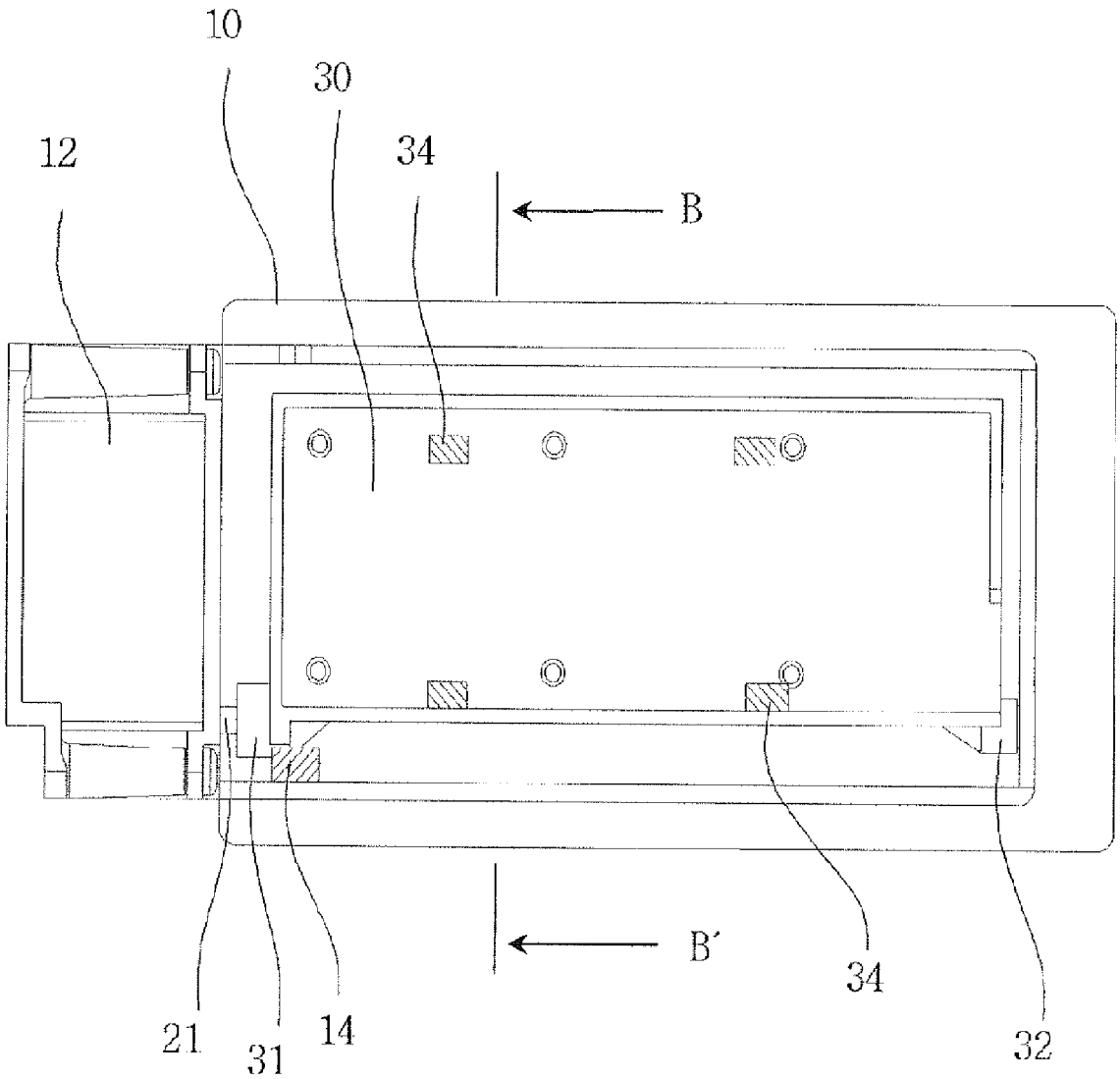
FIG. 4 is a front view showing a damper device for a refrigerator according to another embodiment of the present invention.
Figure 5:
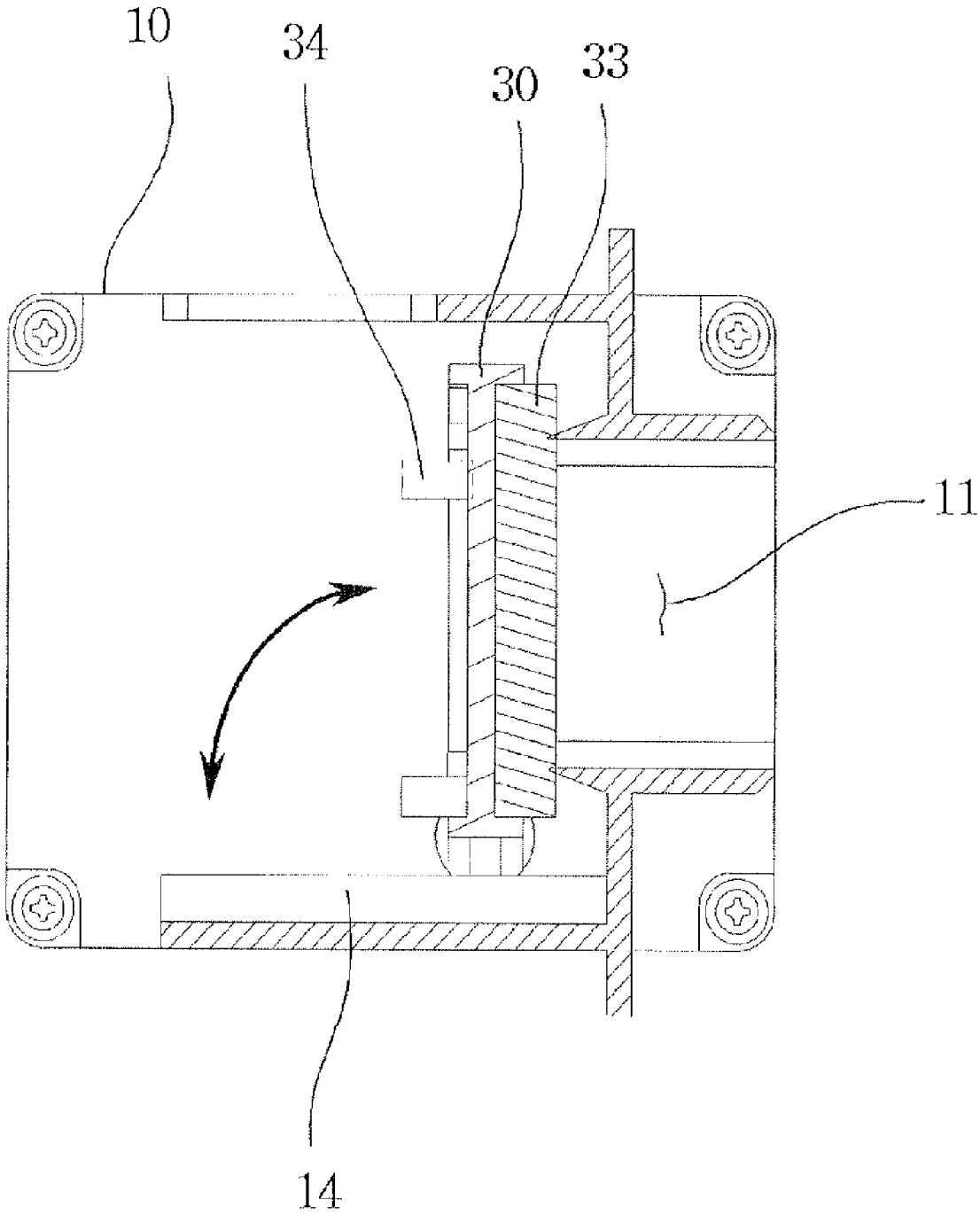
FIG. 5 is a sectional view taken along line B–B' of FIG. 4.

FIG. 4 is a front view showing a damper device for a refrigerator according to another embodiment of the present invention and FIG. 5 is a sectional view taken along line B–B' of FIG. 4.

The damper device for a refrigerator according to another embodiment of the present invention, as shown in FIGS. 4 and 5, has a number of baffle stoppers 34 formed as protrusions in a predetermined size protruding from predetermined portions of the back surface of the baffle 30.

The baffle stoppers 34 are adapted to abut the inner surface of the frame 10 when the baffle 30 is in the desired maximum opening position and limit the maximum opening condition thereof.

The frame 10 has a frame stopper 14 formed as a protrusion in a predetermined size protruding from a predetermined portion of the inner surface thereof.

The frame 14 is adapted to abut the baffle 30 when the baffle 30 is in the desired maximum opening position and mechanically limits the opening operation of the baffle 30.

More than one baffle stoppers 34 and frame stoppers 14 may be provided if necessary.

The baffle stoppers 34 formed on the back surface of the baffle 30 and the frame stopper 14 formed on the inner surface of the frame 10 may be separately manufactured and coupled to the baffle 30 and the frame 10, respectively. In consideration of efficiency of manufacturing processes, however, the baffle 30 and the frame 10 are preferably integrally injection-molded together with the baffle stopper 34 and the frame stopper 14, respectively.

In summary, the inventive damper device for a refrigerator uses the baffle stopper 34 and/or the frame stopper 14 to mechanically limit the desired maximum opening position of the baffle 30. Accordingly, any error in the opening position of the baffle 30 caused by erroneous operation of the gear-equipped step motor 20 is avoided and complete opening/closing operation of the baffle 30 is realized.

As mentioned above, the damper device for a refrigerator according to the present invention uses a gear-equipped step motor as a driving source and has a stopper installed on the frame or baffle for coincidence with the electrical signal inputted to the step motor when the baffle opens/closes the opening of the frame. This guarantees secured opening/closing operation of the baffle, avoids loss and leakage of cold air inside the refrigerator, and improves the efficiency of the refrigerator.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

What is claimed is:

1. A damper device for a refrigerator, comprising:

a frame installed in the cold air passage of the refrigerator and provided with an opening at the center thereof;

a baffle rotatably installed on the frame to open/close the opening;

a gear-equipped step motor installed on a surface of the frame and having a reduction gear and a motor integrally formed therein to transmit a rotation force necessary for opening/closing operation of the baffle; and a stopper adapted to mechanically limit the baffle in such a manner that it can be positioned in the desired opening position, wherein the baffle has an output shaft cap formed on a surface thereof to be coupled to an output shaft of the gear-equipped step motor and a rotation support shaft cap formed on the other surface thereof to be coupled to a rotation support shaft formed on the frame.

2. The damper device for a refrigerator as claimed in claim 1, wherein the stopper has a baffle stopper protruding from the output shaft cap of the baffle.

3. The damper device for a refrigerator as claimed in claim 2, wherein the stopper has a step-shaped frame stopper formed on a portion of the frame abutting the baffle stopper when the baffle is in the desired maximum opening position.

4. The damper device for a refrigerator as claimed in claim 1, wherein the stopper has a number of baffle stoppers formed on the back surface of the baffle in the shape of protrusions.

5. A damper device for a refrigerator, comprising:

a frame installed in the cold air passage of the refrigerator and provided with an opening at the center thereof;

a baffle rotatably installed on the frame to open/close the opening;

a gear-equipped step motor installed on a surface of the frame and having a reduction gear and a motor integrally formed therein to transmit a rotation force necessary for opening/closing operation of the baffle; and a stopper adapted to mechanically limit the baffle in such a manner that it can be positioned in the desired opening position, wherein the stopper is installed on each of the baffle and the frame.

* * * * *